US005345980A

United States Patent [19]

Burt et al.

[11] Patent Number: 5,345,980

[45] Date of Patent: Sep. 13, 1994

[54] METHOD AND APPARATUS AN AEROSOL CONTAINER

[75] Inventors: Peter C. W. Burt, Royston; Laurie K. H. Kwok, Ware, both of England

[73] Assignee: Glaxo Group Limited, London, England

[21] Appl. No.: 117,980

[22] Filed: Sep. 7, 1993

Related U.S. Application Data

[63] Continuation of Ser. No. 4,180, Jan. 13, 1993, abandoned, which is a continuation of Ser. No. 924,376, Jul. 31, 1992, abandoned, which is a continuation of Ser. No. 585,396, Sep. 20, 1990, abandoned.

[30] Foreign Application Priority Data

Sep. 21, 1989 [GB] United Kingdom ..... 8921337

[51] Int. Cl.[5] ..... B01F 3/00

[52] U.S. Cl. ..... 141/3; 141/20; 141/105; 141/9; 137/112

[58] Field of Search ..... 141/3, 20, 100, 104, 141/105, 2, 3, 18, 21, 90, 91, 9; 137/112, 563; 53/470, 474

[56] References Cited

U.S. PATENT DOCUMENTS

| | | | |
|---|---|---|---|
| 2,505,799 | 5/1950 | Smith | 141/20 X |
| 2,518,064 | 8/1950 | Rapisarda | 141/3 X |
| 2,641,399 | 6/1953 | McBean | 141/3 |
| 2,684,806 | 7/1954 | McBean | 141/3 X |
| 3,058,538 | 10/1962 | Dawson et al. | 141/20 X |
| 3,502,118 | 3/1970 | Assalit | 141/20 |
| 3,583,446 | 6/1971 | Rush, Jr. | 141/105 |
| 3,636,993 | 1/1972 | Thornton | 141/20 |
| 3,642,035 | 2/1972 | Marand | 141/20 |
| 3,972,343 | 8/1976 | Burge | 137/112 |
| 4,066,766 | 1/1978 | Kadin | 514/257 |
| 4,863,073 | 9/1989 | Burt et al. | 222/402.2 |
| 4,872,491 | 10/1989 | Nickason et al. | 141/20 |
| 4,921,020 | 5/1990 | Pamper | 141/20 |

FOREIGN PATENT DOCUMENTS

| | | |
|---|---|---|
| 1575277 | 9/1980 | United Kingdom . |
| 2153010 | 8/1985 | United Kingdom . |

*Primary Examiner*—J. Casimer Jacyna
*Attorney, Agent, or Firm*—Darby & Darby

[57] ABSTRACT

The application describes a method of introducing into a container a suspension or solution of a material in a propellant held under pressure, in particular a pharmaceutical material. The method comprises the steps of bringing a filling head into communication with the container; introducing a quantity of such suspension or solution into the container through the filling head; introducing a quantity of high pressure propellant without any of the said material into the filling head, thereby to flush through any suspension or solution remaining in the filling head; and withdrawing the filling head from the container. An apparatus and a filling head for carrying out the method are also described.

3 Claims, 5 Drawing Sheets

METHOD AND APPARATUS AN AEROSOL CONTAINER

This is a continuation of application Ser. No. 08/004,180, filed Jan. 13, 1993, now abandoned, which is in turn a continuation of Ser. No. 07/924,376, filed Jul. 31, 1992, now abandoned, which is also in turn a continuation of Ser. No. 07/585,396, filed Sep. 20, 1990, now abandoned.

BACKGROUND OF THE INVENTION

This invention relates to a method and apparatus for introducing into a container a material to be dispensed in aerosol form and a propellant therefor. The invention is particularly concerned with the introduction of pharmaceutical materials into containers, and the following description concentrates on this. It is to be understood, however, that the invention can also be applied to other materials.

Conventionally, pharmaceutical materials which are to be dispensed in aerosol form are usually suspended in a mixture of at least two propellants, at least one of which has a high enough boiling point to be liquid at room temperature, and at least one of which has a low enough boiling point to be a gas at room temperature.

For convenience, these are referred to below as a liquid, or low pressure, propellant, and a gaseous, or high pressure, propellant respectively. The pharmaceutical material is first suspended in the liquid propellant by a mixing operation. Each aerosol container is then partly filled with this suspension. A quantity of the gaseous propellant is then introduced into each of the containers using either a cold-fill method or a high-pressure method. In the former, the filling operation is carried out at a temperature sufficiently below room temperature for the gaseous propellant to be liquid. Each container is then closed by a closure which includes an outlet valve through which the contents of the container can subsequently be dispensed. In the high-pressure method, the closure is applied to the container before the gaseous propellant is introduced, and that propellant is introduced subsequently into each container by forcing it under pressure into the container through the outlet valve, which during this operation acts in effect as an inlet valve.

No satisfactory method currently exists for filling a container with a suspension or solution of a pharmaceutical in a single or multi-component propellant which is gaseous at room temperature. It is an object of one aspect of the present invention to provide such a method, and to provide an apparatus for carrying out that method.

FIG. 1 shows the introduction into a container C of a suspension of a pharmaceutical material in a liquid propellant. Vessel 1 contains a bulk supply of this suspension which is pumped by a pump 2, through a non-return valve 3, into a metering cylinder 4 provided with a vent 5. From there, the suspension passes to a filling head 8. In the inoperative condition the suspension passes through the head 8 to a non-return valve 9 and thence back to the vessel. The suspension is thus kept constantly in circulation. When a quantity of suspension is to be introduced into the container C, the container is positioned below the head 8, and the valves 3 and 9 are closed. The pneumatic cylinder 6 is then operated to force the piston therein downwardly, thus increasing the pressure in the suspension trapped between the valves 3 and 9 to a level sufficiently to open a valve in filling head 8 and to cause suspension to pass from the filling head into the container C. The valves 3 and 9 are then opened and the valve in filling head 8 shut, and when the piston in the cylinder 6 is withdrawn to its original position the cylinder 4 refills from the vessel 1. Movement of the filling nozzle into and out of engagement with each can is effected by a piston and cylinder arrangement 7. The filling head 8 is arranged to operate only when it is in engagement with a container C.

The apparatus of FIG. 1 introduces into container C a suspension of pharmaceutical material in a liquid propellant, and after an aerosol valve is crimped on the can C the apparatus shown in FIG. 2 operates on it to introduce gaseous propellant. The apparatus of FIG. 2 is formed of components which are substantially the same in principle as corresponding components of FIG. 1, except that there is nothing corresponding to the non-return valve 9 and there is no recycling. Components in FIG. 2 are denoted by reference numerals which correspond to those used in FIG. 1, with the addition of 10. The vessel 11 contains gaseous propellant only, under sufficient pressure for it to be a liquid, and contains no pharmaceutical material.

When the apparatus of FIG. 2 is in operation, a small quantity of gaseous propellant escapes each time the filling head 18 is lifted from a container C. This is of no particular consequence provided the amount of propellant lost in this way is small.

However, this feature of the operation of the apparatus of FIG. 2 means that were it used for introducing into a container a suspension or solution of a pharmaceutical material in a high pressure propellant, it would be entirely unsatisfactory. It can be seen that if vessel 11 contained such a suspension or solution, what would escape each time the filling head 18 was lifted from a container would be a quantity of such a suspension or solution. This would present a hazard to workers involved in the operation, and where the pharmaceutical material concerned was an expensive one, could also represent a significant financial loss. Furthermore, the escaped pharmaceutical material would tend to deposit on the surrounding part of the apparatus and on the exterior of the container itself, giving rise to problems of cleaning. The first of these problems could be avoided, in theory, by surrounding the apparatus of FIG. 2 by an exhaust system, though this would involve considerable expense. The other two problems would not be avoided even by such an exhaust system.

BRIEF SUMMARY OF THE INVENTION

According to the present invention there is provided a method of introducing into a container a suspension or solution of a material in a propellant held under pressure, which comprises bringing a filling head into communication with the container; introducing a quantity of such suspension or solution into the container through the filling head; introducing a quantity of high pressure propellant without any of the said material into the filling head while it is still in communication with the container, thereby to flush through any suspension or solution remaining in the filling head; and withdrawing the filling head from the container.

According to the present invention there is further provided an apparatus for introducing into a container a suspension or solution of a material in a propellant held under pressure, which comprises a filling head adapted to be brought into and out of communication with the container; means for supplying to the filling head a quantity of the said suspension or solution; and means for supplying to the filling head a quantity of high pressure propellant without any of the said material, the filling head being so arranged that the flow of propellant without any of the said material flushes out any suspension or solution remaining in the filling head.

The invention also provides a filling head for use in introducing into a container a suspension or solution of a material in a propellant held under pressure, comprising an outlet adapted to communicate, in use, with the container; first and second inlets each communicating with the said outlet via a common flow path, through which inlets, in use, propellant containing the said material, and high pressure propellant not containing the said material, are respectively introduced; and means for selectively closing the first and second inlets so that fluid entering either inlet cannot flow out of the other.

In all aspects of the invention, it is advantageous and convenient if the propellant without the suspension or solution is the same propellant as that in which the material is held. Advantageously, the propellant is 1,1,1,2-tetrafluoroethane (also known as propellant "134*a*").

Preferably, the material being filled into the container is a pharmaceutical substance, for example salbutamol or beclomethasone dipropionate.

BRIEF DESCRIPTION OF THE DRAWINGS

Preferred embodiments of the invention are described below, by example only, with reference to FIGS. 3, 4A–4D and 5 of the accompanying drawings, in which.

DETAILED DESCRIPTION

Figure 2:
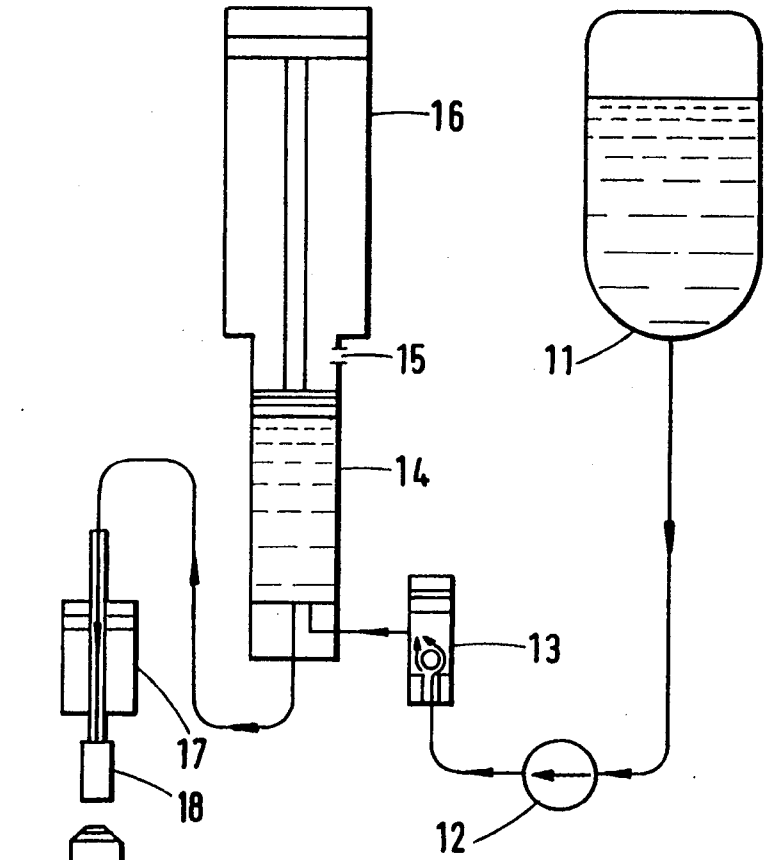
FIG. 2 PRIOR ART
FIGS. 1 and 2 show diagrammatically a conventional apparatus for introducing into a container a pharmaceutical material and a two-component propellant system.
Figure 1:
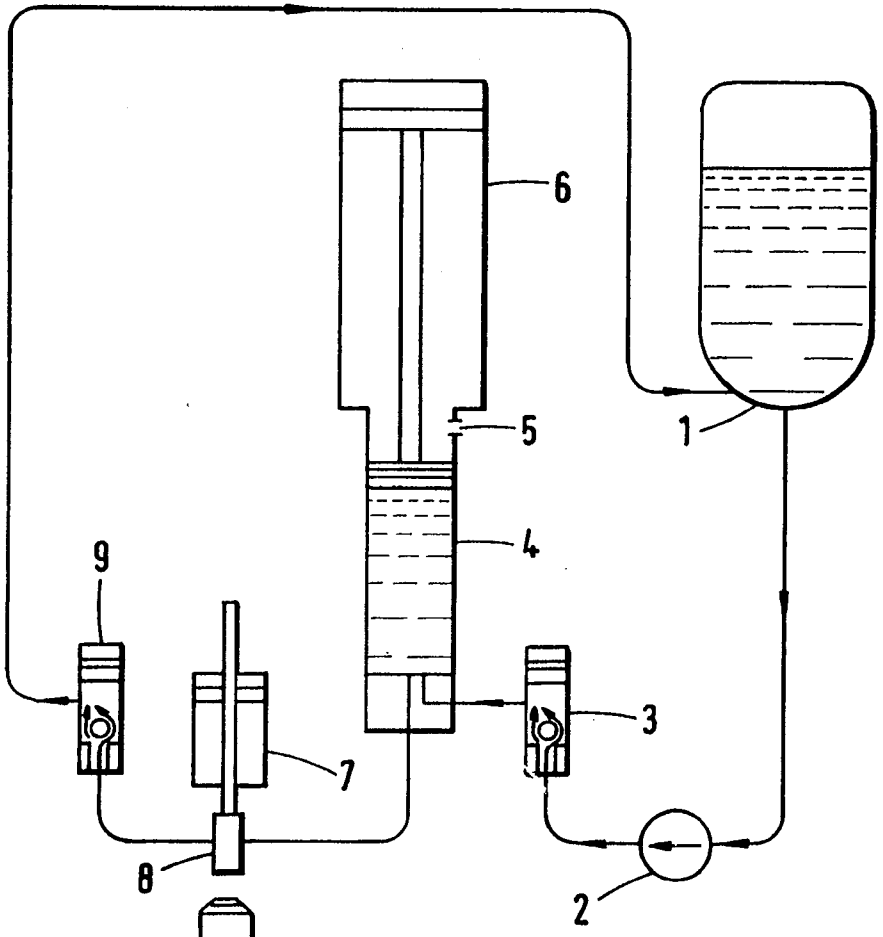
FIG. 1 PRIOR ART
Figure 3:
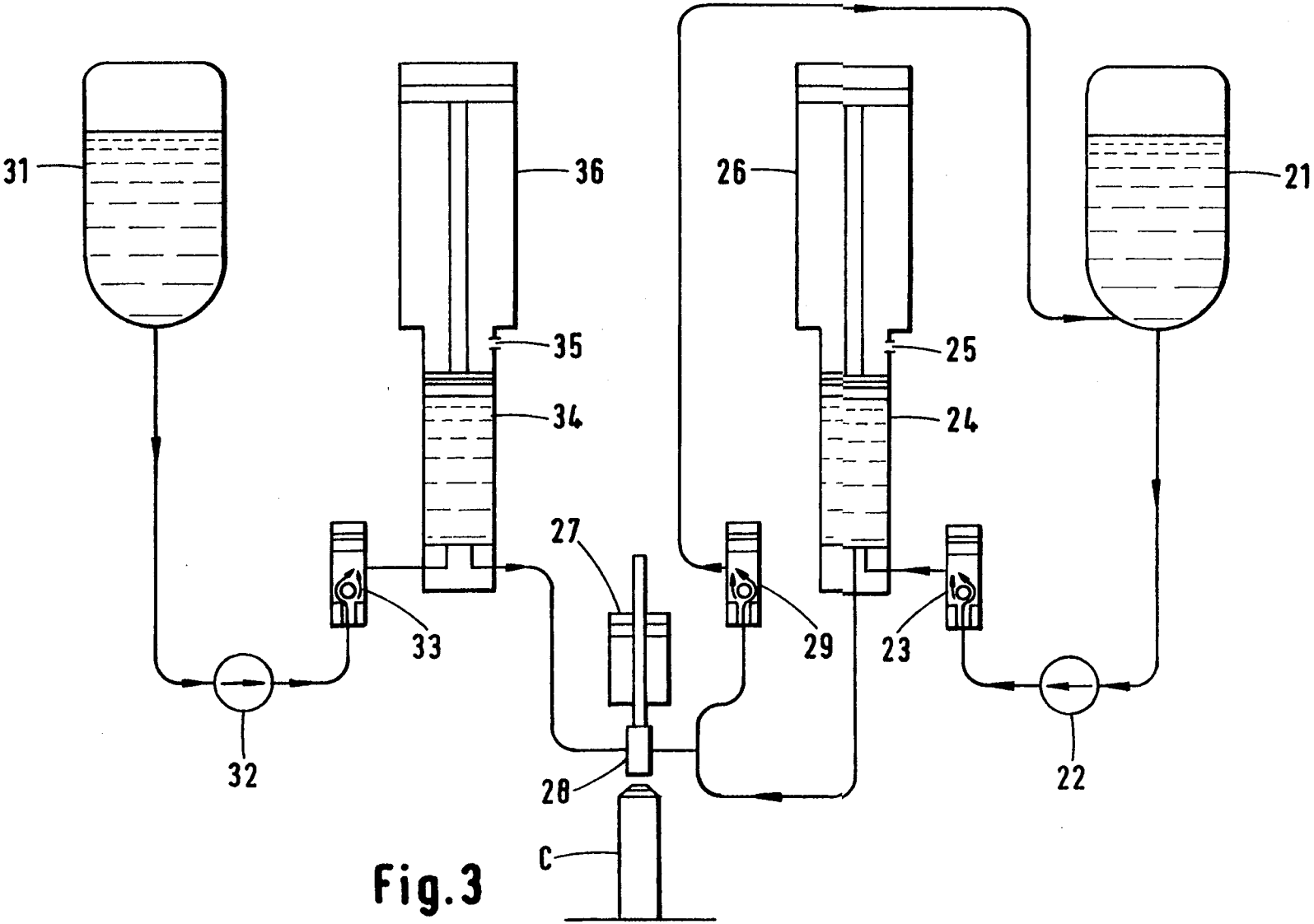
FIG. 3 shows diagrammatically the apparatus of the present invention.

The apparatus according to the invention shown in FIG. 3 comprises, in effect, something resembling a combination of the apparatus of FIGS. 1 and 2, but with a common filling head of a novel design. The components shown in FIG. 3 are denoted by reference numerals which correspond to those shown in FIG. 1, but with the addition of 20 or 30. The vessel 21 contains a suspension of a pharmaceutical material in a high-pressure propellant, and the vessel 31 contains a supply of the same propellant alone, i.e. without any pharmaceutical material suspended therein. Although the vessel 31 here contains the same propellant, a different high pressure propellant can of course be used. Furthermore, vessel 21 might contain a solution of the pharmaceutical material, instead of a suspension.

FIGS. 4A–4D show in more detail, and on a larger scale, the filling head 28 used in the apparatus of FIG. 3. The head comprises a substantially cylindrical body 40, the lower end of which is adapted, in use, to engage over the upper end of an aerosol container C. A tubular member 43 is mounted for slidable movement within the body 40. The tubular member 43 has a wide base portion 44, a narrower body portion 45 and a still narrower neck portion 46. In this context, "wide" and "narrow" refer to diameters.

The neck portion 46 of the tubular member 43 penetrates the base of an inverted cup 47, the wall of which surrounds the body portion 45. The body portion 45 can thus slide into the cup 47.

The base portion 44 of the tubular member abuts an inwardly extending lip 50 of the body 40. An outwardly extending lip 51 of the cup 47 rests on an internal shoulder 52 of the body 40.

A tubular pillar 55 is threadedly engaged with the body 40 such that its lower edge engages on the lip 51 of the cup 47. The pillar 55 thus fits around the wall of the cup 47.

A ring 56 is screwed into the pillar 55 so that it is mounted above the cup 47. The neck portion 46 of the tubular member 43 just enters into the ring 56. A sliding seal 58 is fitted between the ring 56 and the neck portion 46. Rubber O-ring seals 59, 60 are also provided between the ring 56 and the pillar 55 and in the base portion 44 of the member 43, where the nozzle of the container C fits (see later).

The ring 56 defines an upwardly tapering seat 62 for a correspondingly shaped plug 63. The plug 63 is biassed into the seat by a compression spring 64, the upper end of which acts against an inwardly directed lip 65 of the pillar 55.

Above the lip 65 are opposed inlets 69, 70 connecting from the exterior with the interior of the pillar 55, and thus with the interior of the tubular member 43, and so to the container.

Inlet pipes 72, 73 are fitted into the inlets 69, 70 respectively, sealed therein by O-ring seals 74, 74'.

Between the inlets is provided a ball-bearing 75 which can close against either O-ring seal 74, 74' to form a valve. As explained below, the ball bearing 75 is either forced against the O-ring 74 to seal the inlet 69 or against the O-ring 74' to seal the inlet 70.

Above the inlets 69, 70, the pillar 55 provides a circular seat for a piston (not shown) which acts to press the filling head down onto the container C.

The inlet 69 is connected to the line which carries the suspension from the metering cylinder 24 to the non-return valve 29. The inlet 70 is connected to the outlet of the metering cylinder 34 which contains propellant.

In its rest state, suspension S flows along the line from the metering cylinder 24 to the non-return valve 29 without entering the interior of the pillar 55, being prevented from doing so by the ball bearing valve 75, forced against the O-ring 74 by the over-pressure of propellant P in the line from cylinder 34. When it is desired to introduce a quantity of suspension into the container through the head 28, as described immediately below, the valves 23 and 29 are closed and the cylinder 26 operated to cause the piston therein to move downwardly.

Figure 4A:
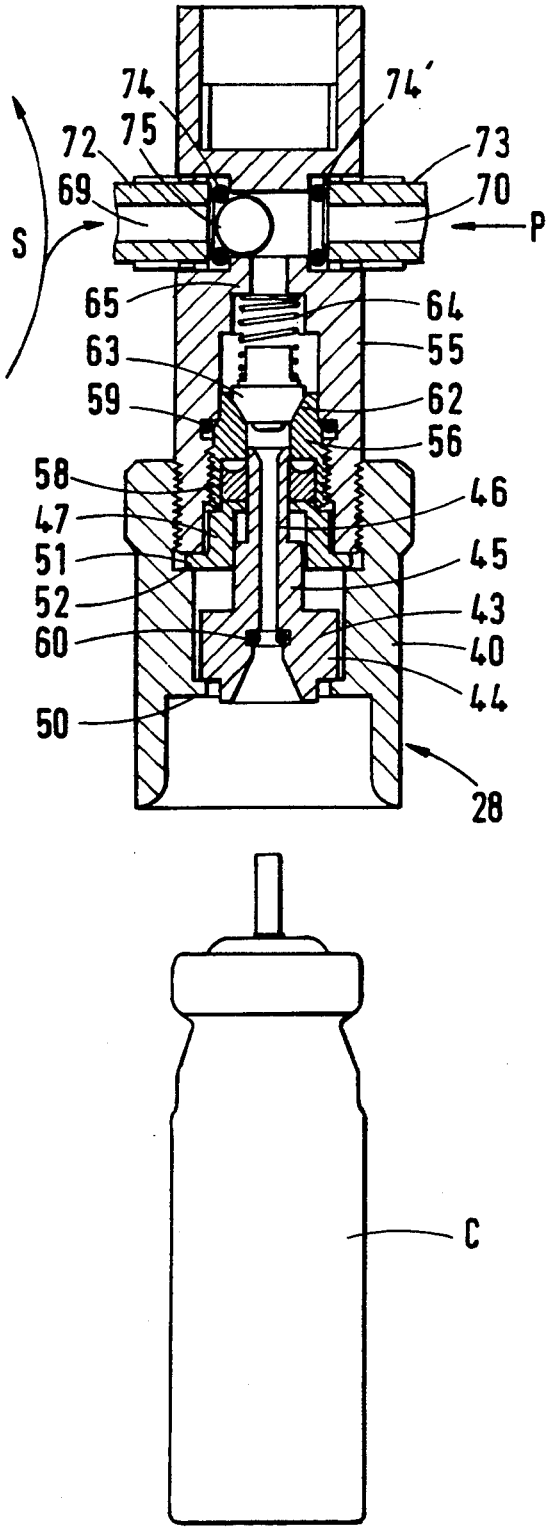
FIGS. 4A–4D show one embodiment of a filling head which may be used in the apparatus of FIG. 3.
Figure 4B:
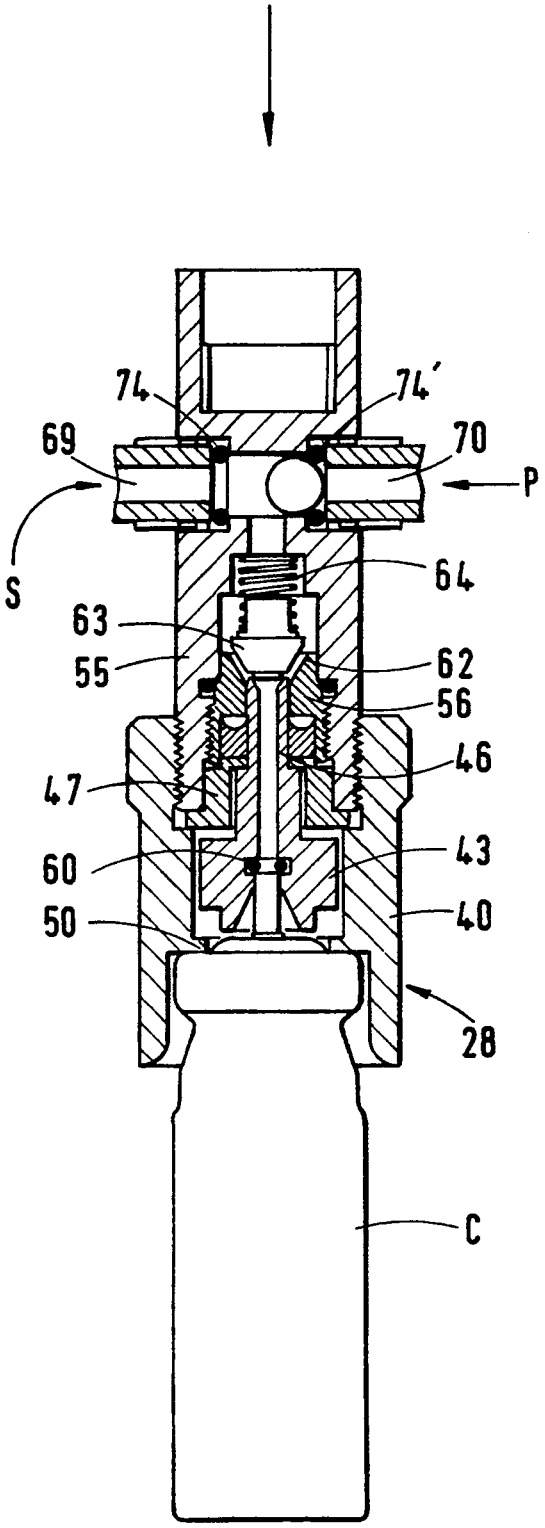

At this stage the filling head 28 has been moved downwards, onto container C, as shown in FIG. 4B. The nozzle of the container rests against O-ring seal 60 and, as the head is lowered, the nozzle forces the tubular member 43 into the cup 47 and ring 56 until the lip 50 of the body 40 abuts the rim of the container. In this position, the neck portion 46 of the tubular member 43 has penetrated through the ring 56 and pushes the plug 63 out of the seat 62, against the action of the spring 64. Communication between the interior of the pillar 55 and the interior of the tubular member 43 is now possible.

The increase in pressure of the suspension in the metering cylinder 24 which is caused by the operation of cylinder 26 is sufficient to overcome the force of the propellant on the ball bearing valve 75 and suspension is thus able to flow from the inlet 69, through the interior of the pillar 55 and the tubular member 43, and into the container. The inlet 70 remains closed since the pressure of the suspension forces the ball bearing valve 75 against O-ring 74'. Thus, suspension is unable to pass from the inlet 69 to the inlet 70 and contaminate the inlet 70.

Figure 4C:
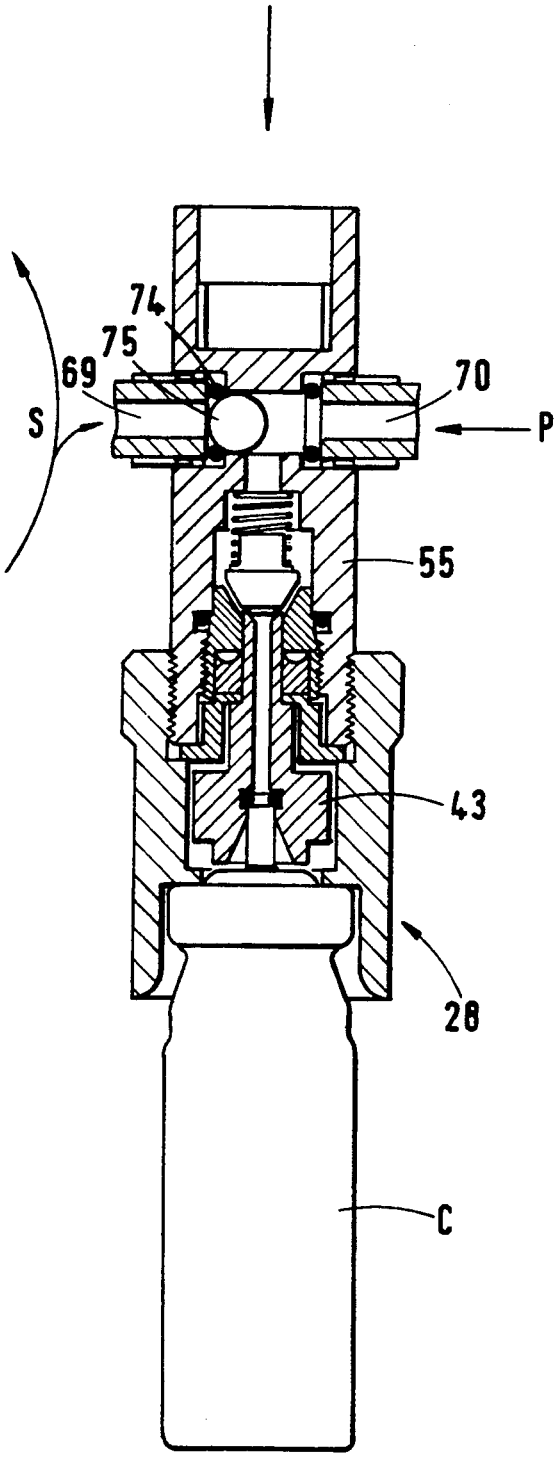

The next stage in the filling of the container is to pass a quantity of propellant without any pharmaceutical material suspended therein into the head 28, through the interior of the pillar 55 and of the tubular member 43, and thence into the container. This is done by closing the valve 33 and operating the pneumatic cylinder 36. The increase in the pressure of the propellant which this causes is sufficient to move the ball bearing valve 75. Propellant is unable to pass from the now open inlet 70 to the inlet 69 because of the ball bearing valve 75 which is forced against O-ring 74. This position is shown in FIG. 4C.

Figure 4D:
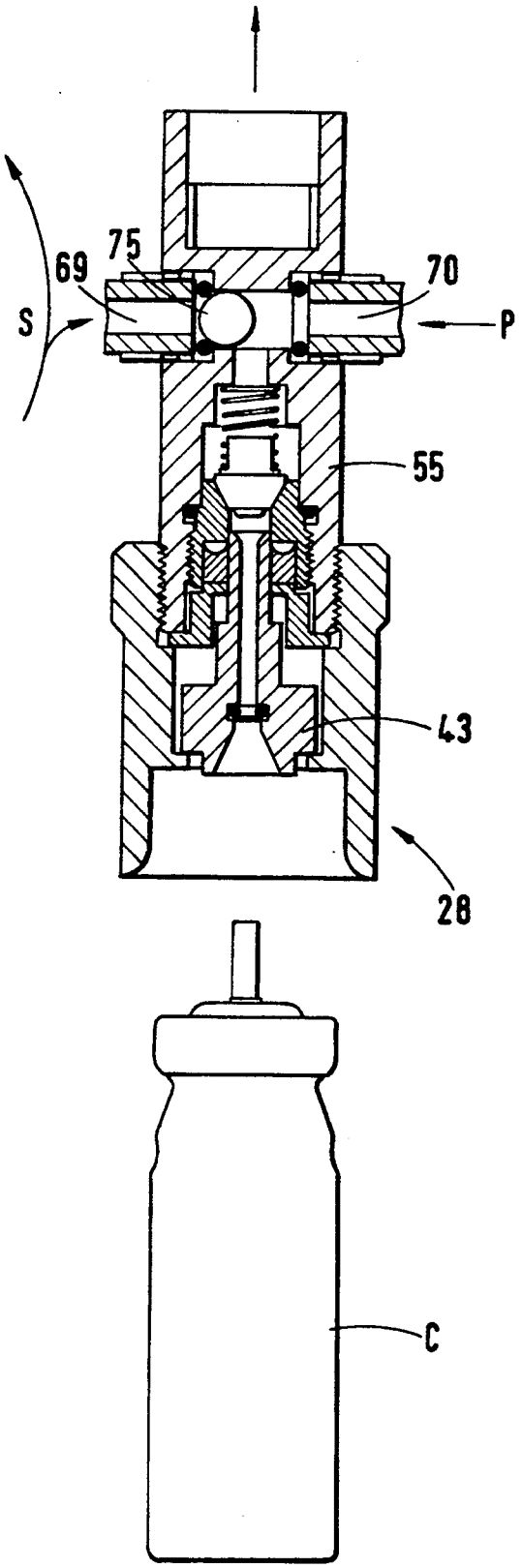

Introducing propellant through the inlet 70 while the head 28 is still on container C flushes out suspension remaining in the interior of the pillar 55 and the tubular member 43. Accordingly, when the head 28 is lifted from the aerosol container after the filling operation has been completed, as shown in FIG. 4D, such material as escapes from the lower end of the head consists substantially entirely of propellant, and no pharmaceutical material escapes into the surrounding atmosphere.

Figure 5:
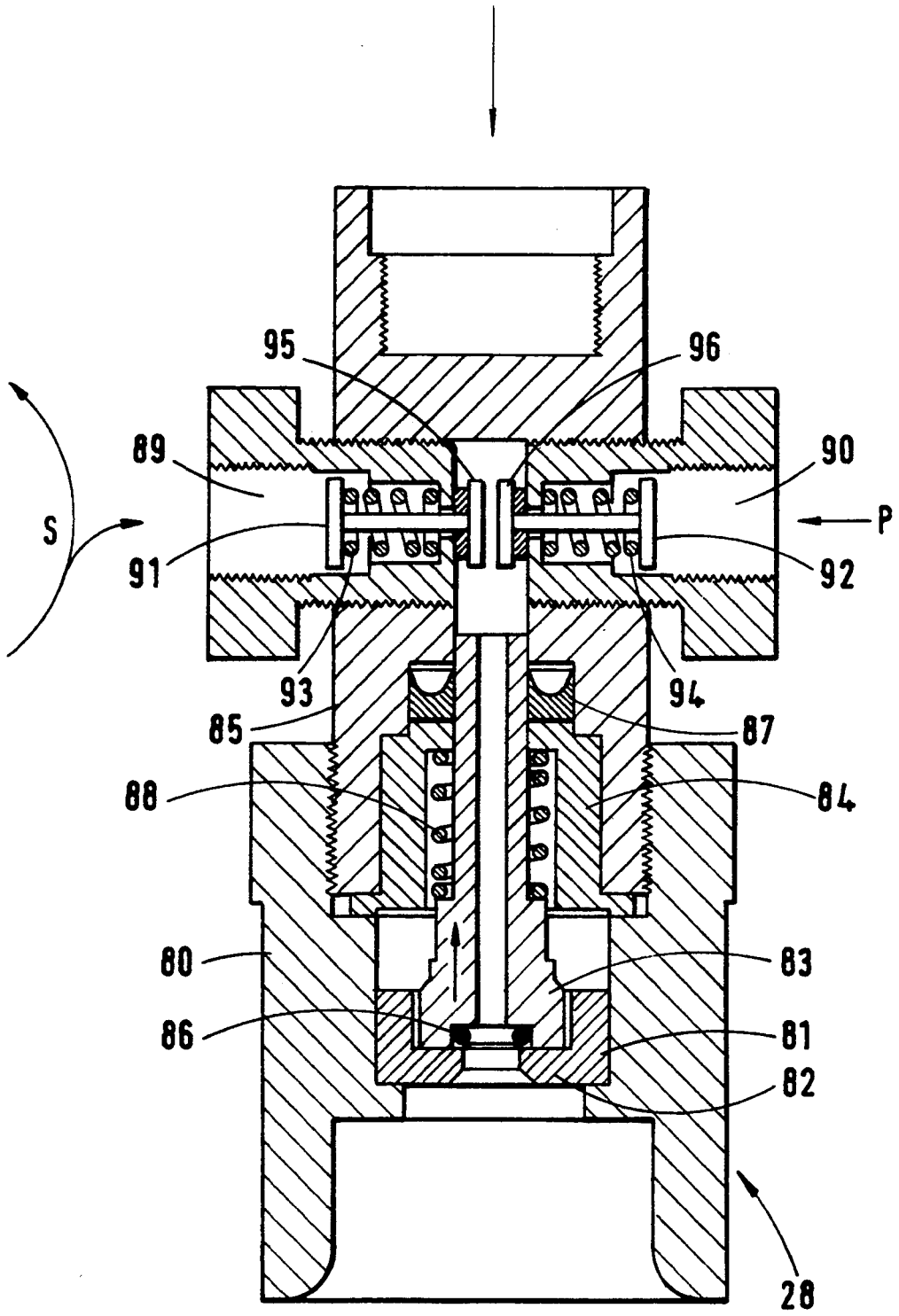
FIG. 5 show another embodiment of a filling head which may be used in the apparatus of FIG. 3.

FIG. 5 shows an alternative embodiment of a filling head 28 to be used in the apparatus of FIG. 3. The head shown in FIG. 5 comprises a substantially cylindrical body 80, the lower end of which is adapted, in use, to engage over the upper end of an aerosol container (not shown in this figure). A ring 81 is mounted for longitudinal sliding movement within the body 80 and has an inwardly directed flange 82 on which rests the lower end of a tubular member 83. The upper portion of the tubular member 83 is surrounded by an inverted cup 84. The cup 84 is in turn surrounded by the annular lower portion of a pillar 85. The annular portion is screw threaded into the body 80 to retain the cup 84 in place and sealing is provided by an O-ring seals 86 and a sliding seal 87. The tubular member 83 is urged into engagement with the flange 82 by a compression spring 88, the upper end of which bears against a face of the cup 84.

The pillar 85 has a pair of opposed inlets 89 and 90. The inlet 89 is connected to the line which carries suspension from the metering cylinder 24 to the non-return valve 29. The inlet 90 is connected to the outlet of the metering cylinder 34 which contains propellant. The inlets 89 and 90 communicate with the interior of the tubular member 83 via respective poppet valves 91 and 92 which are biassed by compression springs 93 and 94 into their closed positions.

As in the embodiment of FIG. 4, in its rest state, suspension flows along the line from the metering cylinder 24 to the non-return valve 29 without entering the interior of the tubular member 83, being prevented from doing so by the valve 91. When it is desired to introduce a quantity of suspension into the container through the head 28 the valves 23 and 29 are closed, and the cylinder 26 operated to cause the piston therein to move downwardly. The increase in pressure in the suspension in the metering cylinder 24 which is caused by this is sufficient to overcome the force of the spring 93 holding the valve 91 shut, and suspension is thus able to flow from the inlet 89, through the interior of the tubular member 83, into the container. The valve 92 remains closed, and indeed the effectiveness of the seal which it provides is increased by the head 95 of the valve 91 engaging the head 96 of the valve 92. Thus, suspension is unable to pass from the inlet 89 to the inlet 90 and contaminate the inlet 90.

The next stage in the filling of the container, as in the previous embodiment, is to pass a quantity of propellant without any pharmaceutical material suspended therein into the head 28, through the tubular member 83, and thence into the container. This is done by closing the valve 33 and operating the pneumatic cylinder 36. The increase in the pressure of the propellant which this causes is sufficient to open the valve 92 to permit propellant through the head 28. Propellant is unable to pass from the inlet 90 to the inlet 89 because of the action of the valve 91.

Introducing propellant through the inlet 90 while the head 28 is still on the container flushes suspension remaining in the interior of the tubular member 83 and in the space immediately above the tubular member. Accordingly, this embodiment also provides that when the head 28 is lifted from the aerosol container after the filling operation has been completed, such material as escapes from the lower end of the head consists substantially entirely of propellant, and no pharmaceutical material escapes.

What we claim is:

1. A method of introducing into a container a suspension or solution of a pharmaceutical substance in a propellant held under pressure, the suspension or solution being circulated in a line which includes a filling head, said method comprising:

bringing said filling head into communication with the container;

introducing a quantity of such suspension or solution into the container through the filling head;

introducing a quantity of high pressure propellant without any of said pharmaceutical substance into the filling head while it is still in communication with the container, thereby to flush through any suspension or solution remaining in the filling head; said filling head permitting introduction of only one of the suspension or solution on the one hand and the propellant alone on the other hand at any one time, the propellant which contains said pharmaceutical substance and the propellant without any of said pharmaceutical substance being the same, said propellant being 1,1,1,2-tetrafluoroethane; and withdrawing the filling head from the container.

2. A method according to claim 1, wherein the pharmaceutical substance is salbutamol.

3. A method according to claim 1, wherein the pharmaceutical substance is beclomethasone dipropionate.

* * * * *